US008206202B2

(12) United States Patent
Hoglund

(10) Patent No.: US 8,206,202 B2
(45) Date of Patent: Jun. 26, 2012

(54) FLEXIBLE GRINDING PRODUCT AND METHOD OF PRODUCING THE SAME

(75) Inventor: Goran Hoglund, Nykarleby (FI)

(73) Assignee: Oy KWH Mirka AB (FI)

( * ) Notice: Subject to any disclaimer, the term of this patent is extended or adjusted under 35 U.S.C. 154(b) by 0 days.

(21) Appl. No.: 13/282,961

(22) Filed: Oct. 27, 2011

(65) Prior Publication Data

US 2012/0045977 A1 Feb. 23, 2012

Related U.S. Application Data

(60) Continuation of application No. 12/422,541, filed on Apr. 13, 2009, now abandoned, and a division of application No. 11/447,485, filed on Jun. 6, 2006, now abandoned.

(30) Foreign Application Priority Data

Jun. 13, 2006 (FI) ..... 20055305

(51) Int. Cl.
*B24D 11/00* (2006.01)

(52) U.S. Cl. ..... 451/533; 451/527; 451/530; 451/539; 51/295; 51/296; 51/297

(58) Field of Classification Search ..... 451/526, 451/527, 529, 530, 533, 538, 539; 51/295, 51/296, 297
See application file for complete search history.

(56) References Cited

U.S. PATENT DOCUMENTS

| | | | |
|---|---|---|---|
| 2,838,890 | A | 6/1958 | McIntyre |
| 3,021,649 | A | 2/1962 | Robbins |
| 4,287,685 | A | 9/1981 | Marton |
| 5,807,161 | A | 9/1998 | Manor et al. |
| 5,810,650 | A | 9/1998 | Jost |
| 6,190,246 | B1 | 2/2001 | Parrott et al. |
| 6,368,199 | B1 | 4/2002 | Van Osenbruggen |
| 6,478,831 | B2 | 11/2002 | Tselesin |
| 6,575,821 | B2 | 6/2003 | Jost |
| 7,252,694 | B2 | 8/2007 | Woo et al. |
| 7,329,175 | B2 | 2/2008 | Woo et al. |
| 7,452,265 | B2 | 11/2008 | Rambosek et al. |
| 2002/0016144 | A1 | 2/2002 | Jost |
| 2002/0061723 | A1 | 5/2002 | Duescher |
| 2004/0180618 | A1 | 9/2004 | Suzuki et al. |
| 2005/0020190 | A1 | 1/2005 | Schutz et al. |
| 2005/0079802 | A1 | 4/2005 | Saunier et al. |
| 2006/0019579 | A1 | 1/2006 | Braunschweig et al. |

FOREIGN PATENT DOCUMENTS

| | | |
|---|---|---|
| EP | 0413956 | 2/1991 |
| EP | 0781629 | 2/1997 |
| FI | 96584 | 4/2006 |
| WO | WO 96/07509 | 3/1996 |
| WO | WO 96/13358 | 5/1996 |

*Primary Examiner* — Eileen P. Morgan
(74) *Attorney, Agent, or Firm* — Altera Law Group, LLC

(57) ABSTRACT

The present invention relates to a flexible grinding product and a method of producing the same. Such a grinding product comprises a flexible underlay (1) which consists of two layers laminated to each other. These comprise a lower base layer (2) and an upper layer (3), a cavity layer. The underlay includes a top surface (5) having at least one adhesive layer (6) arranged thereto after lamination and a layer of grinding agent (7) applied by means of the adhesive layer. The grinding product is characterized in that the layer that is coated with grinding agent includes holes which form cavities (4), whereby the cavities provide space for grinding dust and grinding residues and facilitate their removal from the surface being ground.

8 Claims, 3 Drawing Sheets

FLEXIBLE GRINDING PRODUCT AND METHOD OF PRODUCING THE SAME

FIELD OF THE INVENTION

The invention relates to a flexible grinding product according to the disclosure herein. The invention further relates to a method of producing a similar grinding product according to the disclosure herein.

Grinding product of this kind includes special recesses for removal of grinding dust from the grinding surface and for cooling the grinding surface.

BACKGROUND OF THE INVENTION

Production of discoid grinding products consisting of a flexible underlay, such as paper, is well known. One side of the underlay is provided at least with one adhesive layer, which includes an essentially continuous layer of grinding agent substantially applied thereto.

To enable continuous maintenance of the grinding product's grinding effect, as much of the grinding dust released during grinding as possible must be removed from the space between the grinding product and the grinding surface of the object being ground. As the underlay of such grinding products has not conventionally been air and dust permeable, the grinding products have usually been provided with specific perforated openings, which extend through the grinding product and are connected to air ducts, for example, through which grinding dust can be sucked out while grinding continues. Such products are described in EP 0 781 629, for instance.

These prior art grinding products are produced so that an otherwise finished grinding product is fed through an apparatus where the grinding product is provided with holes by perforation or another piercing process. However, this way of providing the grinding product with through-holes has several disadvantages. Perforation causes cracks and other undesired deformations at the edges of the holes, both in the underlay and in its adhesive layer. Due to crack formation and deformations, the material bridges between the holes must be made relatively wide because narrow material bridges can easily break. Consequently, the holes must be placed at a relatively long distance from one another, as a result of which the grinding product is not cleaned efficiently enough and its grinding effect decreases relatively fast during grinding.

Such perforation also causes other disadvantages. Perforation of the underlay weakens the grinding product to such an extent that a continuous grinding belt cannot be formed of it. The reason for this is that perforation causes increased stretching in the underlay when it is subjected to stress. In addition, an edge perpendicular to the main plane of the grinding product is often formed at the hole edges of the underlay in the perforation process. This edge makes the removal of grinding dust through the holes of the grinding product more difficult. It is further generally known that the perforator wears fast during perforation because of the hard grinding agent.

Most of the above-mentioned disadvantages can naturally be avoided by coating the underlay of the grinding product after it has been perforated, impregnated and coated with a sufficient number of adhesive layers as described in U.S. Pat. No. 2,838,890. The problem associated with this solution is that this grinding product cannot be used in producing a continuous grinding belt, or grinding belts made of perforated grinding products can only be produced from grinding products having a relatively thick underlay. The underlay must be thick so as avoid stretching of the grinding belt. However, the impregnation and coating of the underlay in accordance with the above-mentioned US publication makes the underlay brittle, which means that the grinding product can be bent only a little without breaking it. A grinding belt made of this grinding product would thus break easily in use. If the grinding belt is sufficiently elastic so that is does not break, there is the risk that the grinding belt is stretched too much by belt tension.

Net-like grinding products with a cloth base provided with through-holes for dust removal have also been devised. Such a solution is described in WO 96/13358, for example. The problem associated with this solution is that the cloth requires a special production technique and its use is thus expensive. Also the processing and coating of the cloth require special methods. Furthermore, the finished product has the disadvantage that the cut and perforated edges are weakened by the holes that are on the cutting line since they form notches in the edge of the finished product.

Finally, it may be mentioned that the problem arising in connection with the above-mentioned perforation of grinding products has been relieved by using as the underlay an open cloth or a net where most of the surface is air-permeable. Grinding products produced this way have, however, a poorer grinding capacity than the grinding products described earlier because a continuous and substantially even layer of grinding agent cannot be applied to a cloth or a net. The grinding agent layer will not be in a uniform main plane but will follow the uneven surface of the cloth or net in different planes. As the amount of grinding agent acting on the surface of the work piece is smaller per unit area compared to a case where the whole surface is coated with grinding agent, the grinding effect will decrease. Such a grinding product is described in FI 96584, for example.

BRIEF DESCRIPTION OF THE INVENTION

The problems involved in prior art solutions can be substantially avoided by the present invention. The object of the invention is thus to provide a flexible grinding product which is easy to handle, has a high strength and a sufficient dust removal capacity.

This object is achieved by the flexible grinding product and its production method characterized herein. Respective dependent claims describe suitable further embodiments and variants of the invention that improve its operation.

The present description and the appended claims use the terms "pore" and "porosity" to refer to a channel structure that substantially goes through a material. This channel structure may be formed artificially or it may be a natural characteristic of the material.

The term "grinding surface" means the surface of a work piece at which the effect of the grinding product is directed.

The grinding product and the method of producing the same according to the invention provide several significant advantages over the prior art. It is thus not necessary to make perforations to an underlay already coated with grinding agent since the adhesive layer is applied to an underlay whose upper surface has already been provided with holes obtained by laminating a cavity layer to a base layer. This naturally simplifies the production of the grinding product as well as reduces the costs. The hole structure on the top surface of the underlay can also be achieved in a simple manner so that no cracks or edge is formed in the coating at the edges of the hole. As no cracks are formed, the holes on the upper surface can be arranged very close to one another and thus the material bridges between the holes can be narrow. This makes both the removal of grinding dust and cooling of the grinding surface more effective.

A further substantial advantage provided by the invention is that the adhesive layer will extend as a substantially continuous layer from the top surface of the underlay to its hole structure and to the edge surfaces provided therein.

Since the adhesive layer extends over the edge surface of the hole structure, the transitional area between the underlay's top surface and edge surface is uniform and smooth without any cracks or edges, which facilitates collection of grinding dust particles from the space between the top surface of the grinding product and the work piece to the grinding product.

The adhesive layer will also strengthen the edge surfaces of the underlay as well as the bottom sections of the recesses which are formed from the hole structure since the adhesive layer, if desired, may also impregnate these surfaces. The adhesive layer can thus cover part of the edge surface or even the whole surface of the recesses.

The grinding product can also be made very flexible by laminating two substantially unstretchable thin materials to each other. This way the grinding product can be used in producing continuous grinding belts, for instance.

The dust transportation properties of the grinding product are better than those of competing products since the hole structure in the top surface of the underlay forms a temporary storage place or reservoir for dust and grinding residues during grinding. This way dust and grinding residues may be stored in holes and recesses while the grinding product is against the grinding surface. As soon as air flow can be generated at the grinding product, the collected dust or grinding residues can be transported further.

The dust transportation properties can be improved further by forming the base layer of a porous material. Such material can be preferably used in the production of grinding products for oscillating grinding machines, for example, where the requirements for stretch resistance are not as high as in the case of a grinding belt.

When the material of the base layer includes a fastening element or the lower side of the base layer is provided with fastening loops known per se, the grinding product can be easily applied to known grinding machines.

Further advantages and details of the invention will appear from the description below.

BRIEF DESCRIPTION OF THE FIGURES

In the following, the invention will be described in greater detail with reference to the drawings, in which.

DETAILED DESCRIPTION OF PREFERRED EMBODIMENTS

In the following, a preferred embodiment of a flexible grinding product is described with reference to the above-mentioned figures. The solution comprises the components shown in the figures, each of the components being provided with a respective reference number. These reference numbers correspond to the ones used in the description below.

Figure 2:
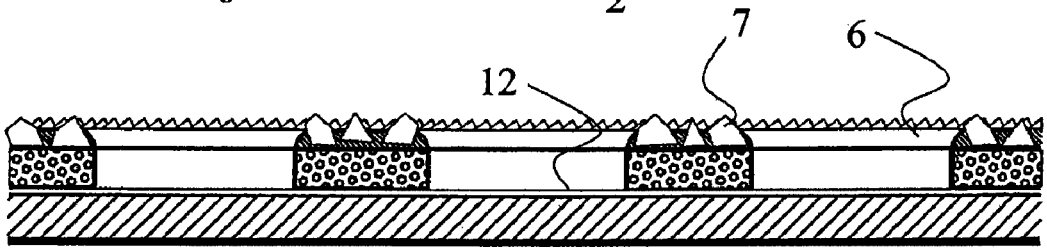
FIG. 2 shows a cross section of the grinding product according to the embodiment of FIG. 1 where the grinding agent layer of the grinding product is also visible.
Figure 3:
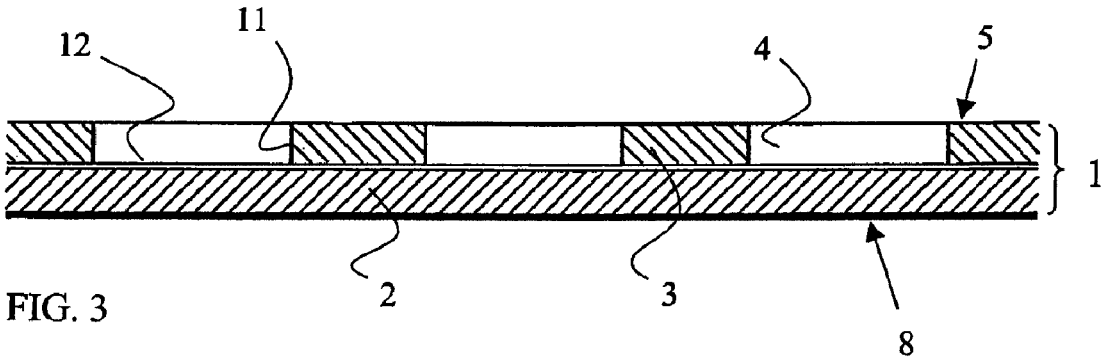
FIG. 3 shows a cross section of an embodiment of the grinding product where the cavity layer is formed of a perforated material.
Figure 4:
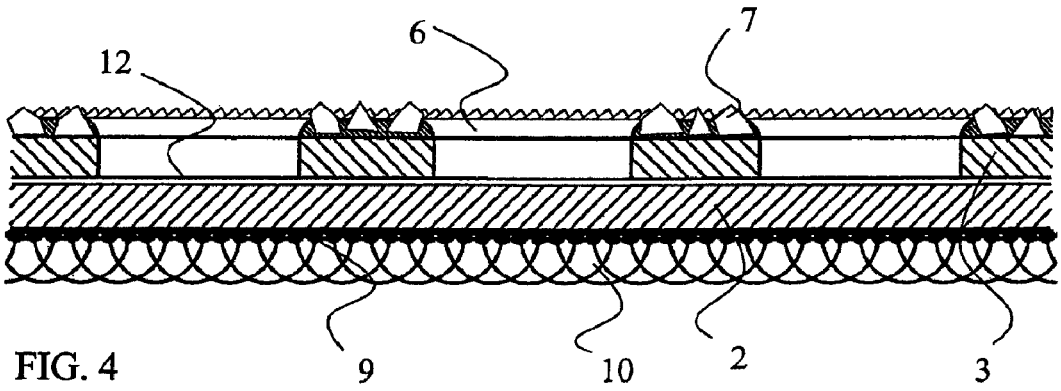
FIG. 4 shows a cross section of the grinding product according to the embodiment of FIG. 3 where the grinding agent layer and fastening cloth on its opposite side are also visible.

The flexible grinding product shown in the figures comprises an underlay 1, which consists of paper, woven cloth or film made of suitable polymer, for instance. As shown in the figures, the underlay comprises two layers laminated to each other, i.e. a lower base layer 2 and an upper porous layer provided with grinding agent, which will be referred to as a cavity layer 3 in the following. This cavity layer may be naturally porous and dust permeable in accordance with FIGS. 1 and 2, but it may also be preferably obtained by perforating a suitable paper or film to provide it with holes having a suitable shape, as shown in FIGS. 3 and 4, for example. The structure of the underlay can be best seen from FIGS. 1 and 3.

Figure 1:
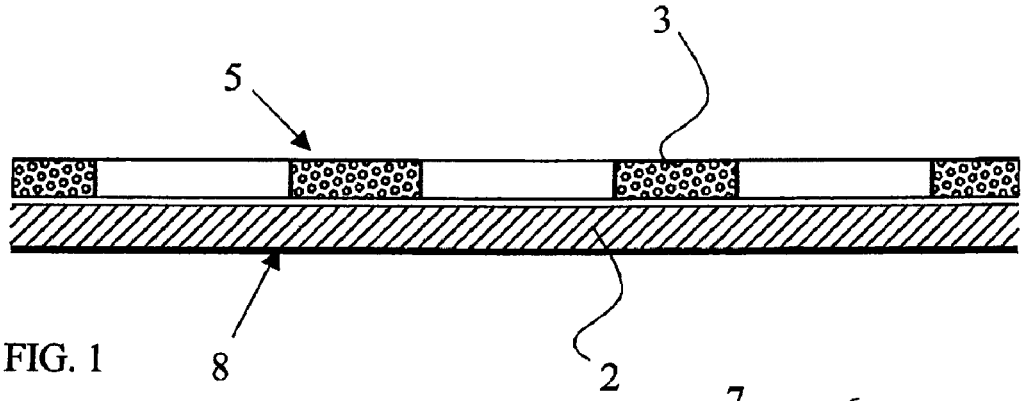
FIG. 1 shows a cross section of an embodiment of a grinding product according to the invention where the cavity layer is formed of a porous material.

If the porosity of the naturally porous material is sufficient as in the case of a woven net-shaped cloth, for example, no separate perforation is needed to obtain the intended hole structure; otherwise even this material can be perforated in advance. FIGS. 1 and 2 schematically show the cavities that are formed in the underlay this way.

When the cavity layer 3 is laminated to the base layer 2, recesses 4 or cavities are formed in accordance with the embodiment shown in FIGS. 1 to 4. The cavities go through one surface of the underlay 1, which will be referred to as the top surface 5 in the following. The number, shape, size and distribution of the recesses may vary according to the need depending on the grinding product. Recesses may be distributed over the cavity layer evenly or randomly. When the cavity layer is perforated, the recesses can even be distributed according to different patterns that recur on the top surface. The distribution and shapes of the perforations are illustrated in FIGS. 7 to 11.

The top surface 5 of the underlay 1 shows, in accordance with FIG. 2 or 4, an adhesive layer 6. Both in and on this adhesive layer, there is a layer of grinding agent 7, in which case the adhesive and grinding agent layers form a substantially continuous layer on the top surface. The surface of the underlay opposite to the top surface, i.e. its lower surface 8, forms a substantially flat and strong layer suitable for a grinding belt. Here it should also be noted that the thickness of the underlay, adhesive layer and grinding agent layer have been exaggerated in the figures for the sake of clarity.

Figure 5:
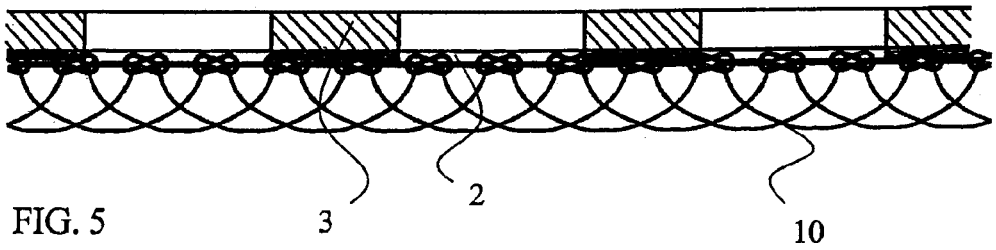
FIG. 5 shows a cross section of an embodiment of the grinding product according to the invention where the base layer is made of a woven cloth.

It is also feasible to arrange a separate fastening layer on the upper lower surface 8 of the underlay 1. This can be formed of a knitted cloth, for example. This cloth preferably has fastening loops 10 on its surface extending from the lower surface, as shown in FIGS. 4 and 5. By means of these fastening loops, the grinding product can be fastened to a Velcro surface (not shown here) arranged in a grinding tool. The cloth with fastening loops may naturally be replaced with another fastening layer known per se, such as a layer of self-adhesive.

The embodiment of the grinding product shown in FIGS. 1 to 4 comprises recesses 4 which are arranged alongside each other and extend through the grinding agent and adhesive layers 7 and 6 and partially into the underlay 1. Thus the recesses form a storage place or reservoirs in the top surface of the grinding product, which function as collectors in removal of grinding dust and residues from the grinding surface. In the embodiments according to FIGS. 1 and 2, the cavity layer contains naturally porous material. In the embodiments according to FIGS. 3 and 4, on the other hand, the cavity layer comprises perforated material where recesses are defined by substantially regular edge surfaces 11 in the underlay. The edge surfaces are substantially perpendicular to the main plane of the grinding product defined by the top surface 5.

According to FIGS. 2 and 4, the substantially uniform adhesive layer 6 extends to the recesses 4 and further over the edge surfaces 11 in the perforated cavity layer 3. The adhesive layer preferably extends as a substantially continuous layer from the upper surface 5 of the underlay over the edge surface, the adhesive layer forming a round edge between the underlay's top surface and edge surface. The adhesive layer may stretch further to the bottom 12 of the recess and even across it to strengthen it.

In a second embodiment according to FIG. 5, the laminated underlay 1 comprises a base layer 2 of porous material, such as a woven or knitted cloth or similar dust permeable material. The material may be preferably finished so as to provide the material with a substantially even and smooth surface as well as with sufficient strength. In that case, the recesses 4 formed of the cavity layer 3 and arranged within alongside each other will form part of a channel structure which extends substantially through the whole underlay.

Figure 6:
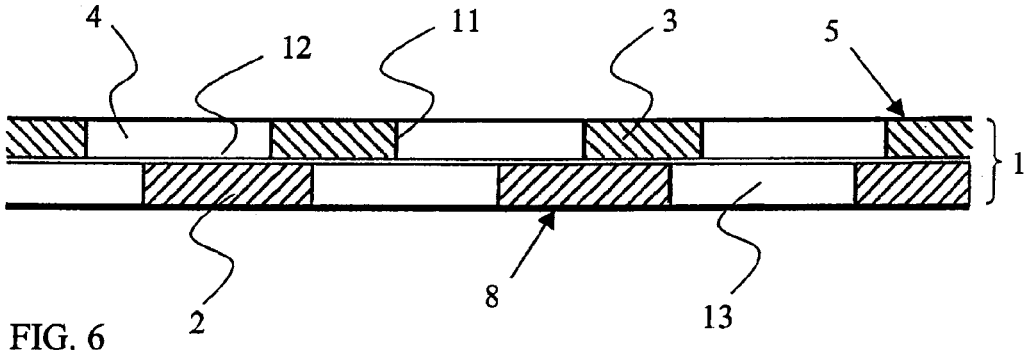
FIG. 6 shows a cross section of an embodiment of the grinding product where the cavity layer and the base layer are both made of perforated material.

In a third embodiment, the laminated underlay 1 comprises a base layer 2 of a material perforated in advance. This perforation can be arranged to substantially overlap with the perforation of the cavity layer, as shown in FIG. 6. The laminate layers and their holes may also be arranged randomly, in which case the recesses 4 alongside each other in the underlay cooperate with the holes 13 in the base layer only at some places to form a channel structure which extends through the underlay.

When the grinding products according to the embodiments are to be used in mechanical grinding, they are provided with fastening loops 10 or a similar fastening layer 9 in the manner described above. If the base layer 2 includes a woven, non-woven or knitted cloth or similar material, the lower surface 8 of the underlay can be provided with suitable fastening loops in accordance with FIG. 4 or 5.

In grinding with a grinding product according to FIG. 2 or 4, the recesses 4 in the main plane will absorb the grinding dust and grinding residues that are removed from the grinding surface during grinding. Thus the recesses transport grinding dust from the direct contact surface between the grinding product and the grinding surface. This enables a longer grinding time compared to a case where the dust would remain on the grinding agent surface and quickly fill again the recesses between the grinding particles. At the same time, the recesses emptied from grinding dust and grinding residues transfer cooler air to the grinding surface, and thus over-heating of the grinding surface can be avoided and the grinding result improved further.

In grinding with a grinding product according to FIG. 5 or 6, a low pressure is achieved on the rear side of the grinding product in a manner known per se, as a result of which air flows from an opening between the grinding product and the grinding surface. Air is sucked into the recesses and further through the pores or holes 13 in the base layer. This air flow thus transports grinding dust and residues removed from the grinding surface in connection with grinding, thus enabling a longer grinding time than in a case where dust would remain on the grinding surface.

In all the embodiments described above, the removal of grinding dust is facilitated as the holes at the edges of the underlay are free from cracks and other irregularities. Thanks to the uniform and continuous grinding agent layer, the material bridges 14 between the holes on the top surface of the underlay can be made narrow. This further facilitates the removal of grinding dust from the area of the material bridges towards the hole structures leading to the holes.

In connection with the production of a discoid flexible grinding product according to FIGS. 1 and 2, a suitably porous material is selected for the cavity layer 3. After this, the cavity layer is laminated as described above to the base layer 2 and to the resulting underlay 1 provided with an adhesive layer 6 and a layer of grinding agent 7. Finally, the lower surface of the underlay is provided with a suitable fastening layer 9.

The discoid flexible grinding product according to FIGS. 3 and 4 is produced by first perforating a paper or a suitable film to obtain a cavity layer 3. Then the cavity layer and the base layer 2 are laminated to form a uniform underlay 1. The top surface of this underlay is provided with an adhesive layer 6, after which a substantially continuous layer of grinding agent 7 is applied to the adhesive layer. This is preferably followed by application of an adhesive surface layer to bind the grinding agent. Finally, a cloth provided with loops or another suitable fastening layer 9, for example, may be fastened to the lower surface 8 of the underlay, preferably by means of fiber-like strings or spots of molten adhesive.

In the production of the discoid flexible grinding product according to FIG. 5, a paper or a suitable film is also perforated first to obtain a cavity layer 3. The difference from the previous embodiment is that the cavity layer is laminated with a porous material, weave or another perforated material 9 to from a uniform underlay. The top of the underlay is correspondingly provided with grinding agent 7 and a fastening layer 9. Since the underlay will thus include a number of through-holes already when the adhesive and grinding agent layers are applied to the underlay, there is no need to make holes to the finished grinding product by perforation or another similar mechanical process. The porous base layer can naturally also be laminated with a cavity layer which is also made of a porous material.

According to FIG. 6, if both the cavity layer 3 and the base layer 2 are made of perforated material, the perforations of both layers can be arranged to substantially overlap with the lamination by providing the laminate layer with similar perforations. On the other hand, the perforations of the laminate layers can be formed randomly as well as laminated together randomly. This way recesses are formed partly in the top surface of the grinding product while perforations will partly overlap, in which case the underlay will comprise pierced openings that go through it. Even if the cavities did not go through the underlay, the dust removal would still be improved since the cavities are emptied more efficiently each time the working angle and the grinding pressure vary.

Here a continuous layer of grinding agent 7 means that the layer of grinding agent comprises a continuous surface through which a hole structure has been pierced. This is contrary to some prior art grinding products where the adhesive and grinding agent layers are not continuous but form separate clusters. Thus the term "continuous" does not require that the grinding agent particles should be closely side by side. They are, however, fastened adjacent to each other by the adhesive layer 6. It can also be seen in the figures that the grinding agent particles are substantially in one plane.

Figure 7:
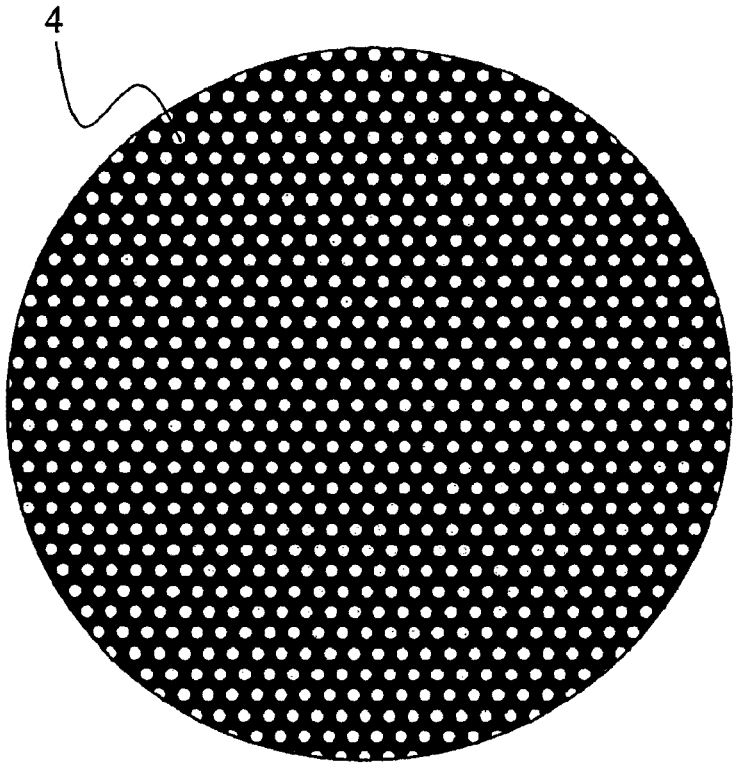
FIG. 7 is a plan view of a grinding disc produced according to the invention.
Figure 8:
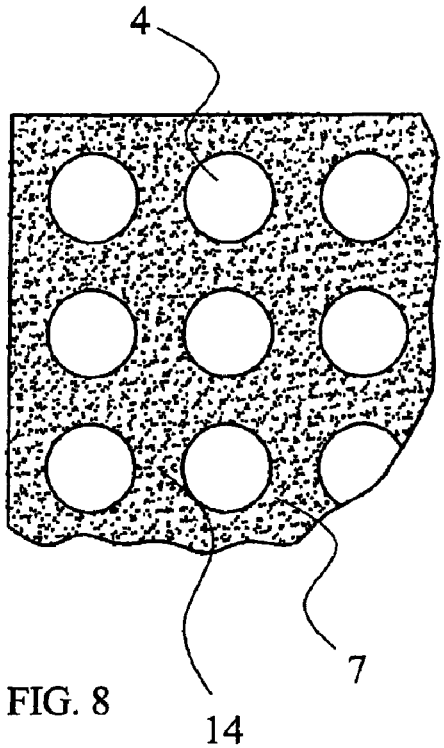
FIG. 8 is a plan view partly showing a second embodiment of the grinding product according to the invention.
Figure 9:
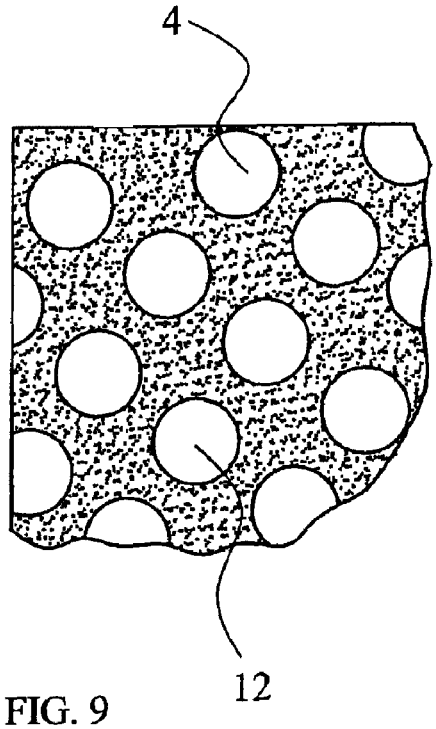
FIG. 9 is a plan view partly showing a third embodiment of the grinding product according to the invention.
Figure 10:
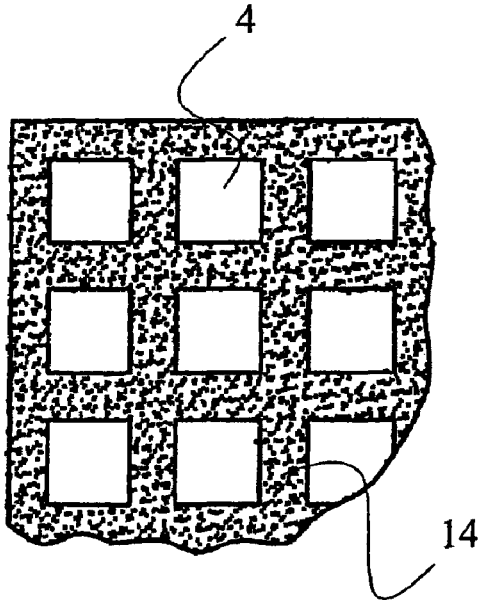
FIG. 10 is a plan view partly showing a fourth embodiment of the grinding product according to the invention.
Figure 11:
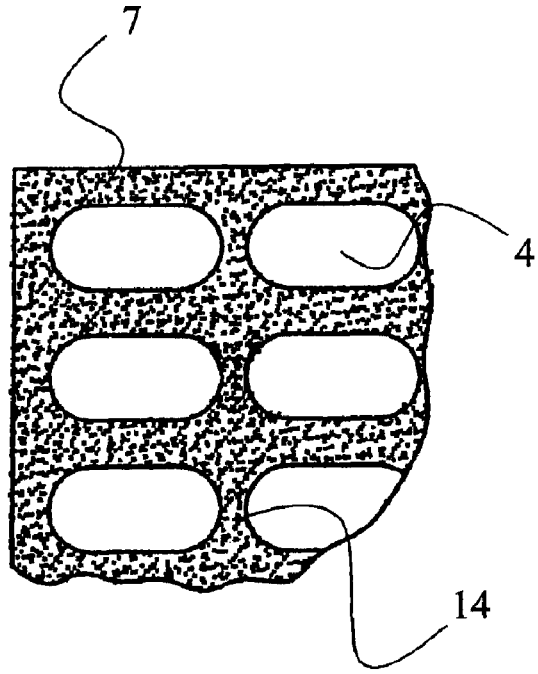
FIG. 11 is a plan view partly showing a fifth embodiment of the grinding product according to the invention.

FIGS. 7, 8 and 9 show a plan view of embodiments of the grinding product where recesses are substantially round. The recesses may naturally be provided with another suitable shape, such as the rectangular recesses shown in FIG. 10 or the elongated recesses shown in FIG. 11. The recesses can be achieved in a conventional manner. The recesses may account for 10 to 70% of the total main plane of the grinding product. In the tests carried out, it was found that recesses should preferably account for 20 to 40% of the main plane of the grinding product.

The grinding product needs not be provided with a cloth having fastening loops or another fastening layer 9. An embodiment without a fastening layer is particularly suitable when the grinding product is formed as a continuous belt for use in a conventional belt grinding machine, which may be provided with a blow-through unit or a suction unit for continuous cleaning of the belt.

The number of adhesive layers on the top surface of the underlay may be even larger than two. For example, a layer known as a supercoat layer can be applied to the top surface to achieve dust rejection, cooling or lubrication.

In the figures, the edge surfaces 11 have been drawn so that they are substantially perpendicular to the main plane of the grinding product, i.e. the top surface 5 and the lower surface 8. However, the whole edge surface or part of it may also form an angle with the main plane of the grinding product. What is essential is that the edge surface can be considered to define a recess in the underlay.

The description and the appended figures are only intended to illustrate the present solution for designing a flexible grinding product. The solution is thus not limited to the embodiments described above or in the enclosed claims but it may be varied or modified within the inventive concept described in the enclosed claims.

The invention claimed is:

1. A method of producing a flexible grinding product, which comprises a flexible underlay consisting of at least one abrasive receiving upper layer having first and second surfaces and a lower layer, the method comprising sequential steps of:

a) first perforating the abrasive receiving layer with through-holes spaced over and through the first and second surfaces thereof;

b) then laminating the second surface of the abrasive receiving upper layer to said lower layer;

c) then applying adhesive selectively to the first surface of the remaining exposed surface of the abrasive receiving upper layer d) then applying abrasive to said adhesive of exposed surface, thereby adhesively bonding the abrasive to the abrasive receiving upper layer;

whereby the through holes remain free of abrasive and retain sharp edged sidewalls created when perforated.

2. A method according to claim 1, wherein the through holes are punched in elongated shapes.

3. A method according to claim 1, wherein the through holes are punch in rectangular shapes with sharp corners.

4. A method according to claim 1, wherein the abrasive receiving layer is made porous.

5. A method according to claim 1, wherein the lower surface of the underlay is provided with a fastening layer.

6. The method of claim 1, further including the step of perforating the lower layer with holes before the laminating step, and aligning the lower layer and abrasive receiving upper layer so that their respective holes are at least partly aligned.

7. The method of claim 1, further including the step of perforating the lower layer with holes before the laminating step and aligning the lower layer and abrasive receiving upper layer so that supporting material between their respective holes are at never fully in alignment.

8. A method according to claim 1, wherein the abrasive receiving layer is made of a naturally porous material.

* * * * *

UNITED STATES PATENT AND TRADEMARK OFFICE

CERTIFICATE OF CORRECTION

PATENT NO. : 8,206,202 B2
APPLICATION NO. : 13/282961
DATED : June 26, 2012
INVENTOR(S) : Goran Hoglund It is certified that error appears in the above-identified patent and that said Letters Patent is hereby corrected as shown below:

On the title page item (30) Foreign Application Priority Data, replace the date "Jun. 13, 2006" with -- Jun. 13, 2005 --.

Signed and Sealed this
Twenty-fifth Day of September, 2012

David J. Kappos

David J. Kappos
*Director of the United States Patent and Trademark Office*